US007654513B2

(12) United States Patent
Buxton et al.

(10) Patent No.: US 7,654,513 B2
(45) Date of Patent: Feb. 2, 2010

(54) FEED ASSIST ASSEMBLY

(75) Inventors: Patrick A. Buxton, Lexington, KY (US); Kevin M. Johnson, Georgetown, KY (US); Michael W. Lawrence, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/077,639

(22) Filed: Mar. 20, 2008

(65) Prior Publication Data

US 2009/0236800 A1 Sep. 24, 2009

(51) Int. Cl.
*B65H 5/00* (2006.01)
*B65H 5/22* (2006.01)

(52) U.S. Cl. ..... 271/4.04; 271/4.1; 271/10.04; 271/10.05; 271/10.11

(58) Field of Classification Search ..... 271/4.04, 271/4.1, 10.01, 10.04, 10.05, 10.11
See application file for complete search history.

(56) References Cited

U.S. PATENT DOCUMENTS

| | | | | |
|---|---|---|---|---|
| 5,203,554 | A * | 4/1993 | Suzuki et al. | 271/10.05 |
| 5,222,723 | A * | 6/1993 | Ijuin | 271/10.11 |
| 5,634,635 | A * | 6/1997 | Kobayashi et al. | 271/3.16 |
| 6,962,332 | B2 * | 11/2005 | Su | 271/4.01 |
| 7,261,289 | B2 * | 8/2007 | Lee et al. | 271/10.04 |
| 2008/0290586 | A1 * | 11/2008 | Kuo | 271/10.11 |

* cited by examiner

*Primary Examiner*—David H Bollinger

(57) ABSTRACT

A media feedpath having a feed assist roller, comprises a media feedpath having a C-shaped portion, a media input and a feed roll nip, an input roller feeding media from the media input, a feed assist roller downstream of the C-shaped portion of the media feedpath, the feed assist roller assisting media indexing through the media feedpath on a single side and without an opposed pinch roller, the feed roll nip having a driven roller and a feed roll pinch roll opposite the driven roll, the feed assist roller being driven by a toggle gear transmission from the driven roller of the feed roll nip, the gear train adapted for toggling to operably engage or disengage the feed assist roller depending on a driving direction of the driven roller of the feed roll nip.

16 Claims, 10 Drawing Sheets

FEED ASSIST ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a media feedpath. More particularly, the present invention relates to a media feedpath having a feed assist assembly positioned along the media feedpath.

2. Description of the Related Art

Printing and other peripherals having media feeding functionality typically feed or index media by utilizing opposed pairs of rollers along a media feedpath. The opposed rollers engage or pinch media rotate to control and advance the media along the feedpath.

When feeding media to a printer or to a scan window of an auto-document feed scanner, the media is typically indexed or advanced through a feed roller nip to either a print zone or scanning zone. However, the media typically extends backward through the feedpath beyond the feed roller nip and therefore may be engaged by other roller nips located along the feedpath. The sum of forces applied by these other roller nips acting on the media introduces resistive forces on the feed roller nip which may cause print or scan defects. Also, C-shaped feedpaths cause additional resistive forces on the feed roller nip due to the bending of the media in passing through the feedpath.

It would be desirable to assist the feed roller nip in advancing media by eliminating or reducing upstream forces from these other nips engaging media. Additionally, it would be desirable to improve media feeding by limiting resistive forces at the feed roller nip in order to decrease print and scan defects.

SUMMARY OF THE INVENTION

A media feedpath having a feed assist roller, comprises a media feedpath having a C-shaped portion, a media input and a feed roll nip, an input roller feeding media from the media input, a feed assist roller downstream of the C-shaped portion of the media feedpath, the feed assist roller assisting media indexing through the media feedpath on a single side and without an opposed pinch roller, the feed roll nip having a driven roller and a feed roll pinch roll opposite the driven roll, the feed assist roller being driven by a toggle gear transmission from the driven roller of the feed roll nip, the gear train adapted for toggling to operably engage or disengage the feed assist roller depending on a driving direction of the driven roller of the feed roll nip. The feed assist roller is spaced from a wall of the media feedpath allowing passage of media there between when the media is driven by the input roller. The feed roll nip pulling the media against the feed assist roller. The toggle gear transmission engaging the feed assist roller when the driven roller rotates in a forward direction. The toggle gear transmission disengaging the feed assist roller when the drive roller rotates in a reverse direction. The toggle gear transmission is a gear train. The media feedpath further comprises a gear generally connected to the feed assist roller for engaging the gear train. The media feedpath is a simplex feedpath. Alternatively, the media feedpath is a duplex feedpath.

A feed assist media feedpath assembly comprises a media feedpath having a media input, a C-shaped portion downstream of the media input, and a feed nip downstream of the C-shaped portion, a feed assist roller positioned between the C-shaped portion and the feed nip for feeding media, the feed assist roller not having an opposed pinch roller, the feed assist roller being over-driven relative to a driven roller of the feed roll nip, a toggle gear train assembly driving the feed assist roller in a forward direction or disengaging the feed assist roller when the driven roller is reversed. The feed assist roller creating a load buffer in the media between the feed assist roller and the feed roll nip. The load buffer being a slight buckle in the media for reducing resistive forces on the feed roll nip. The media feedpath comprising a simplex feedpath portion. The feed assist media feedpath further comprising a duplex feedpath portion. The feed assist roller disposed at a junction between the simplex path and the duplex path.

A feed assist media feedpath comprises a media feedpath having a simplex portion and a feed roll, a feed assist roller disposed along the feedpath, a toggle gear train assembly driven by a feed roll gear, the toggle gear train assembly movable between a first position engaging a feed assist gear for driving the feed assist roller and a second position disengaging the feed assist gear, the feed assist roller frictionally engaging media in order to assist movement of media through the media feedpath and overdriven relative to the feed roll to provide a load buffer at the feed assist roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
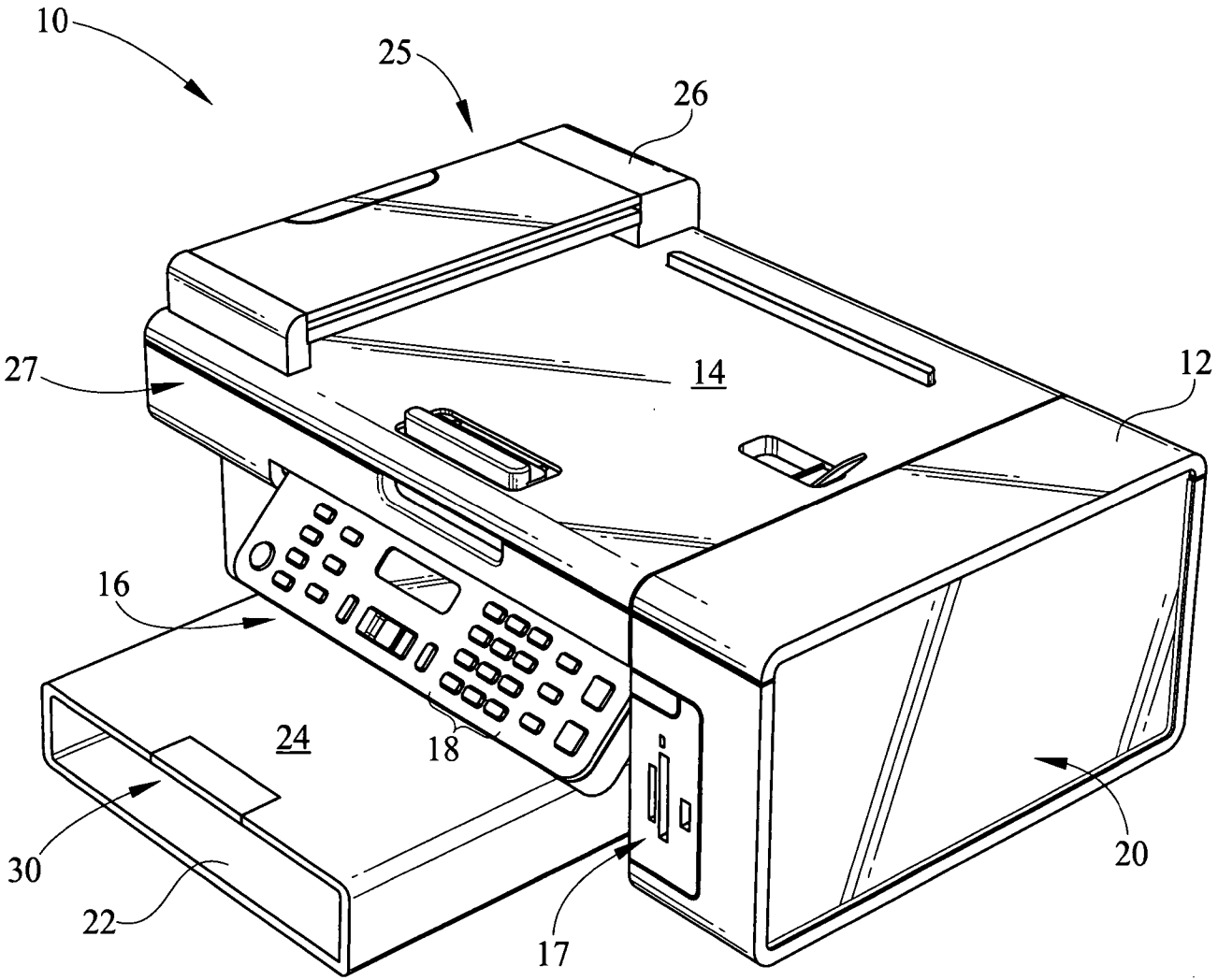
FIG. 1 is a perspective view of an exemplary peripheral device having a media feedpath therein.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. It should be understood that any target document or image may be scanned and manipulated, however for purpose of this description the term "image" will be used throughout. The term output as used herein encompasses output from any printing device such as color and black-and-white copiers, color and black-and-white printers, scanning devices or so-called "all-in-one devices" or "multi-function peripherals" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term ADF as used herein means auto-document feeder and may be utilized on printers, copiers, scanners, combinations thereof, multi-function peripheral devices and other such devices utilizing automated media feeding. The term operations panel, as used herein, means an interactive display allowing for menu display, menu selections, image viewing, editing of images, correction of error conditions and other operations and control functions. The term peripheral may include a single function or multi-function, or all-in-one, device which may be connected to a host computer, network connected or may be a stand-alone, which is a device which may function independently of any host computer. The term nipless feed assist means feeding from a single side of media, without an opposed pinch roller or other structures engaging the opposite of the media so that a single roller merely assists while indexing or feeding occurring elsewhere.

Referring now in detail to the drawings, wherein like numerals indicate like elements throughout the several views, there are shown in FIGS. 1-10 various aspects of a nipless feed assist roller assembly which does not control feeding but assists feeding or indexing of the media at the feed roller nip. The nipless feed assist roller does not utilize an opposed pinch roller to form a nip but instead only frictionally engages one side of the media passing from a C-shaped media path portion in order to assist movement of the media through the C-shaped path. Additionally, the nipless feed assist roller may be overdriven relative to a feed roller to create a load buffer or slight buckle which aids indexing occurring at the feed roller nip by reducing resistive forces on the media upstream of the feed roller nip and inhibit print defects.

Referring initially to FIG. 1, a perspective view of an all-in-one device or a multifunction peripheral device is depicted. An all-in-one device 10 is shown having a print mechanism 20, generally indicated as being within a housing 12 and a scanner portion 25, also located at least in part within housing 12. Although the all-in-one device 10 is shown and described herein, one of ordinary skill in the art will understand upon reading of the instant specification that the present invention may be utilized with a stand alone printer, or other single function peripheral device utilizing a media feed system.

Extending from the housing 12 at the front of the device 10 is a media input 22 and a media output 24 for retaining media before and after a print process, respectively. The exemplary input and output 22,24 are embodied by trays however other media retaining structures may be utilized. The media input and output 22,24 of the printer mechanism 20 define start and end positions of a media printing feedpath 30 through the printer mechanism 20. The media trays 22,24 of the present embodiment are shown as being fixed however it is within the scope of the present description that such trays be telescoping for slidable extension during printing or slidable retraction into a nested configuration when not in use. The media input and output 22,24 each retain a preselected number of sheets defining a stack of media (not shown) which will vary in height based on the media type. The input 22 defines a starting point of the media feedpath 30, which passes through the housing 12 and extends from the front portion of device 10 at the output 24. Although the lower tray 22 is an input tray and the upper tray 24 is an output tray, it is well within the ambit of one of ordinary skill in the art that the input 22 and the output 24 could be reversed to provide a printing feedpath moving from top to bottom. Further, one skilled in the art will understand that the media feedpath 30 is a C-shaped media feedpath due to the depicted configuration but alternatively could be formed as an L-shaped feedpath.

Positioned on an upper portion of the device 10 is a scanner 25. The scanner 25 comprises an auto-document feed (ADF) scanner 26 and a flat bed scanner 27. The flat bed scanner 27 comprises a lid 14 which is hingedly connected to the housing 12 or a frame of the device 10. The lid 14 provides access to a flatbed scanner 27 for scanning target images such as photos, drawings or other target images on media not suitable for auto-document feeding. Positioned on or adjacent the tray 14 is the auto-document feed scanner 26 which comprises a second scanning means generally for the purpose of scanning a plurality of documents suitable for auto-document feeding and may be used to copy, fax, or digitize documents. Where such documents are not suitable for ADF scanning, the flatbed scanner 27 may be utilized. The lid 14 also functions as a media tray since media may be positioned thereon and fed into the auto-document feeder 25.

The all-in-one device 10 further comprises utilizes the print mechanism or printer portion 20 as previously mentioned. For ease of description and clarity, the exemplary printer portion 20 is an inkjet printing device, although other types of printing mechanisms may be utilized such as dye-sublimation, ink-jet printing mechanism or laser printing and therefore should not be considered limiting. And, although not shown specifically, the following general description of printing components will be understood by one of ordinary skill as parts relating to an inkjet printer. The printing portion 20 may include a carriage having a position for placement of at least one print cartridge C (FIGS. 2 and 7-10). In the situation where two print cartridges are utilized, for instance, a color cartridge for photos and a black cartridge for text printing may be positioned in the carriage. As one skilled in the art will recognize, the color cartridge may include three inks, i.e., cyan, magenta and yellow inks. Alternatively, in lower cost machines, a single cartridge may be utilized wherein the three inks, i.e., cyan, magenta and yellow inks are simultaneously utilized to provide the black for text printing or for photo printing. In yet a further alternative, a single black color cartridge may be used. During advancement, media moves from the input tray 22 to the output tray 24 through the substantially C-shaped media feedpath 30 beneath the carriage and cartridge C. As the media M moves into a printing zone, beneath the at least one ink cartridge C, the media M moves in a first direction as depicted and the carriage and the cartridges move in a second direction which is transverse to the movement of the media. During this movement, ink droplets are selectively ejected on to the media indexing through the feedpath 21 to form an image. The scanner 25 will not be described since such devices are known to those skilled in the art.

Along the front surface of the device 10 is an operations panel 16 which comprises a plurality of buttons 18. The operations panel and buttons 16,18 are in communication with a controller (not shown) which controls the various components of the device 10 as previously described. The controller (not shown) receives data communication from a host computer connected to the all-in-one device 10. The controller may be embodied by one or more micro-processors and controls the various functions of the peripheral 10 such as print mechanism 20 and scanner 25. Likewise, the controller provides outputs to signal a user of messages, menu selections, error conditions and the like either audibly or visually, or both. The device 10 may utilize a display on the operations panel 16 for communication visually with the user and may comprise a speaker for providing audio signals to the user. The device controller receives commands from selections made at plurality of control buttons 18 and accordingly operates appropriate components of the device 10, such as the printer 20, scanner 12 or the components described herein. Alternatively, the controller may receive commands from a computer connected to the device 10.

The peripheral device 10 may communicate with a computer or other device in various ways. For example, the device 10 may be connected to a host computer by a parallel cable or a serial cable. Alternatively, a USB cable connection may be utilized to connect the peripheral to the host computer. USB is a serial bus standard to interface peripheral devices providing plug-and-play capabilities by allowing devices to be connected and disconnected without rebooting the computer (hot swapping). USB also provides low power consumption devices without the need for an external power supply. The peripheral 10 may be connected to a CPU (not shown) or USB hub for utilizing the printing and scanning functions of the multi-function peripheral device 10. According to a further alternative, the device may be connected via network connection for example by wired Ethernet or local area network (LAN) connector allowing wired network communication for printing, scanning, faxing or other such functionality. In yet a further alternative, the peripheral may communicate wirelessly, for example using the IEEE 802.11 protocol, infrared or Bluetooth communication. These communication means are known to one skilled in the art and therefore are not described herein.

Additionally, the all-in-one device 10 may comprise a memory card reader station 17. The memory card reader station 17 is depicted adjacent the control panel 16. The memory card reader 17 receives various types of memory cards which may store picture files for printing or other manipulation by the device 10. These include USB flash drives, Secure Digital (SD) cards, micro SD cards, Sony® memory stick devices and the like. The media card reader station 17 receives various media types having images located thereon desired for printing. The images may be displayed on a peripheral device monitor or a monitor connected to a personal or networked computer (not shown) and may subsequently be edited or formatted as desired and printed through printer portion 20, saved to memory card at reader 17, to a computer or to a network storage device (not shown).

Figure 2:
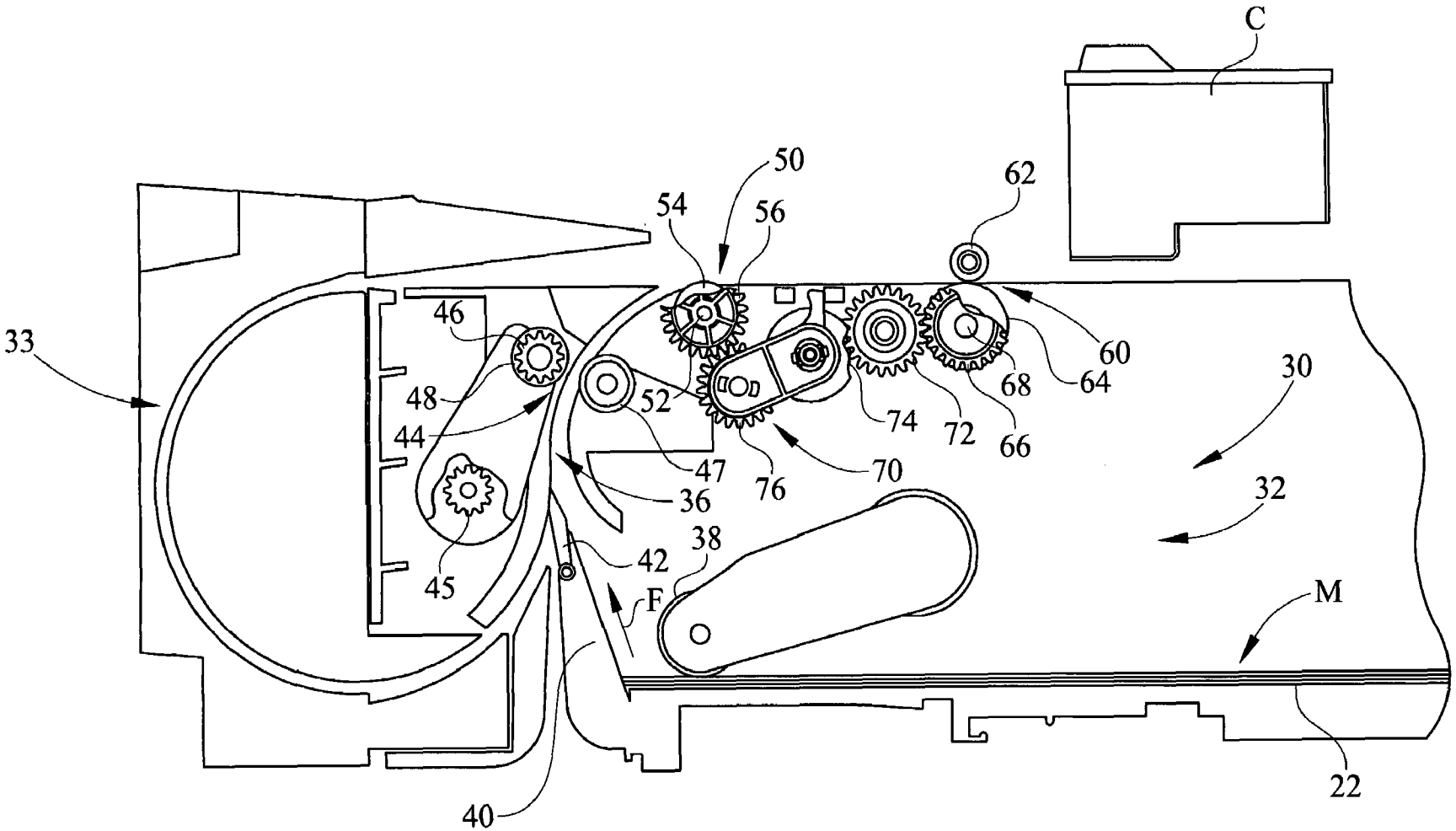
FIG. 2 is a side view of an exemplary media feedpath having a media feed assist roller.

Referring now to FIG. 2, a feedpath 30 is depicted in side view. The feedpath 30 comprises a simplex path portion 32 and a duplex path portion 33. The duplex path portion 33 may be included if double-sided printing is desired however, the duplex path portion 33 is not necessary for use of the nipless feed assist roller described herein. The simplex path portion 32 is generally C-shaped extending from the media input 22 in a feed direction, indicated by an arrow F. The media input 22 may comprise various structures which allow for engagement by an input roller 38. The input roller 38 may be embodied by an auto-compensating mechanism (ACM) as will be understood by one skilled in the art and may be driven by a motor and transmission, such as a belt drive or gear train for example, in order to pick an uppermost media M sheet from the input tray 22 and direct that sheet upwardly along a media dam 40 into the C-path portion 36 of the simplex path portion 32. The C-path portion 36 curves to an upper portion of the feedpath 30 wherein a feed roller nip 60 is positioned for directing the media sheet into a print area beneath a print cartridge C. Since the exemplary embodiment utilizes a duplex path portion 33, a gate 42 is positioned in an upper location of the media dam 40 to guide the media sheet along the C-path portion 36 from the media input 22 and from the duplex path portion 33 where the paths 32,33 are in feeding communication.

Moving along the C-path portion 36 in the feed direction F, a C-path nip 44 is positioned therein for receiving media from the media input 22 as well as the duplex path portion 33. The C-path nip 44 may comprise an ACM, known to one of skill in the art, having at least an input gear 45 and an ACM roller gear 46. A roller 48 is operably engaging the roller gear 46, both of which are connected to a shaft in order to pivot within the C-path portion 36. Opposite the roller 48 is a pinch roller 47 which defines the C-path nip 44 for feeding of media through the C-path portion 36 and onto the feed roller nip 60. The roller 48 is pivotable about the axis of the input gear 45 in order to open or close the nip 44, depending on the feed direction. As one skilled in the art will understand, the C-path nip 44 may be designed to close when a feed roller 64 is moving in reverse and may be geared to feed in a forward direction so that the media M feeding through the duplex path portion 33 is controlled by the nip 44 and fed forward to the feed roller nip 60 during a duplex print pass or a subsequent collation pass.

Moving along the feed direction from the C-path nip 44, a nipless feed assist roller assembly 50 is depicted comprising a feed assist shaft 52 having a nipless feed assist roller 54, which may comprise one or more rollers mounted axially on the feed assist shaft 52. A feed assist gear 56 is connected to the feed assist shaft 52 to receive input from a toggle transmission assembly 70. The nipless feed assist assembly 50 does not utilize a pinch roller opposite the nipless feed assist roller 54 for defining a nip. Instead, the nipless feed assist roller 54 simply utilizes friction between the roller 54 and media M in order to assist media moving toward the feed roller nip 60. However, with some limited amount of resistance, the feed roller 54 will slip relative to the surface of the media due to the lack of an opposed pinch roller, thus the feed roller 54 is merely an assist roller, engaging only a single side of the media M, and is not in full control of the media, by use of a nip, during feeding.

Downstream of the nipless feed assist roller assembly 50 is a feed roller nip 60 comprising a pinch roller 62 opposed from a driven feed roller 64. Disposed concentrically with the feed roller 64 is a feed roller gear 66 which is driven by a motor (not shown) and a feed roller transmission (not shown). The at least one feed roller 64 and feed roller gear 66 are mounted on a feed roller shaft 68, which receives input from the motor and feed roller transmission for driving the toggle transmission assembly 70.

The toggle transmission assembly 70 receives input from the feed roller gear 66 of the feed roller shaft 68. The toggle transmission assembly 70 is embodied by a gear transmission, but various transmissions may be utilized including belt drive and the like. The assembly transmission 70 comprises a first toggle transmission gear 72 which receives input from the feed roller gear 66. The first toggle transmission gear 72 is operably engaging a second toggle transmission gear 74. The first and second toggle transmission gears 72, 74 receive input from the feed roller gear 66 and transmit that rotational torque to a toggle gear 76. The toggle gear 76 engages the feed assist gear 56 to rotate the nipless feed assist roller 54 in the forward direction when the feed roller 64 is rotated in a forward direction. However, the toggle transmission assembly 70 causes pivoting movement of the toggle gear 76 about the second toggle transmission gear 74 and away from the feed assist gear 56 when the feed roller 64 is rotated in a reverse direction, such as during duplex feeding or media de-skew. Otherwise stated, the toggle gear 76 orbits about the transmission gear 74.

Figure 3:
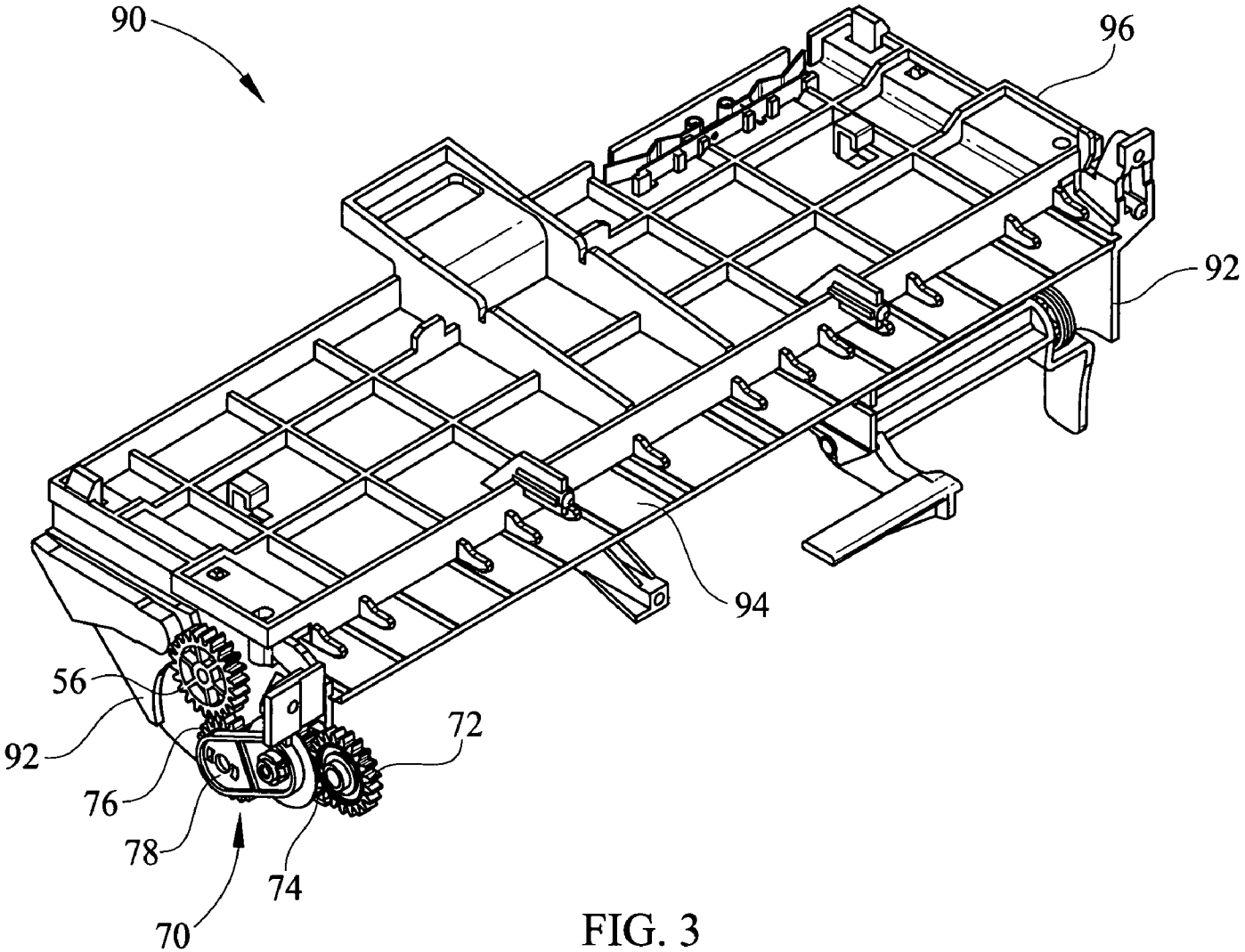
FIG. 3 depicts a perspective view of a paper guide sub-assembly defining a portion of the media feedpath.

Referring now to FIG. 3, a perspective view of an inner paper guide sub-assembly 90 is depicted. The sub-assembly 90 comprises opposed side walls 92 as well as a media surface 94 which defines a lower surface of a simplex feed path 32 in the area of the nipless feed assist roller 54 and moving forward, in the feed direction, toward the feed roller nip 60 (FIG. 2). Disposed above the media surface 94 is an upper media pick guide 96 which defines an upper wall or boundary for the feedpath 30 in the region of the nipless feed assist roller 54 and moving forward toward the feed roller nip 60 (FIG. 2). Disposed adjacent one side wall 92 is the feed assist gear 56. The feed assist gear 56 receives input from the toggle transmission assembly 70, the exemplary embodiment comprising the gears 72, 74 and the toggle gear 76 which is either operably engaged to or disengaged from the feed assist gear 56.

The transmission assembly 70 further comprises a toggle arm 78 which is frictionally engaging the second toggle gear train gear 74 so that when the gear 74 rotates, the arm 78 will move in the same direction as the gear rotation due to the frictional engagement between the arm 78 and the gear 74. Accordingly, in one direction of rotation of the gear 74, the toggle gear 76 moves towards the feed assist gear 56. Alternatively, with an opposite rotation of gear 74, the toggle gear 76 moves away from the feed assist gear 56. Thus rotation of the nipless feed assist roller 54 is controlled by engagement or disengagement of the gear 76 with the feed assist gear 56.

Figure 4:
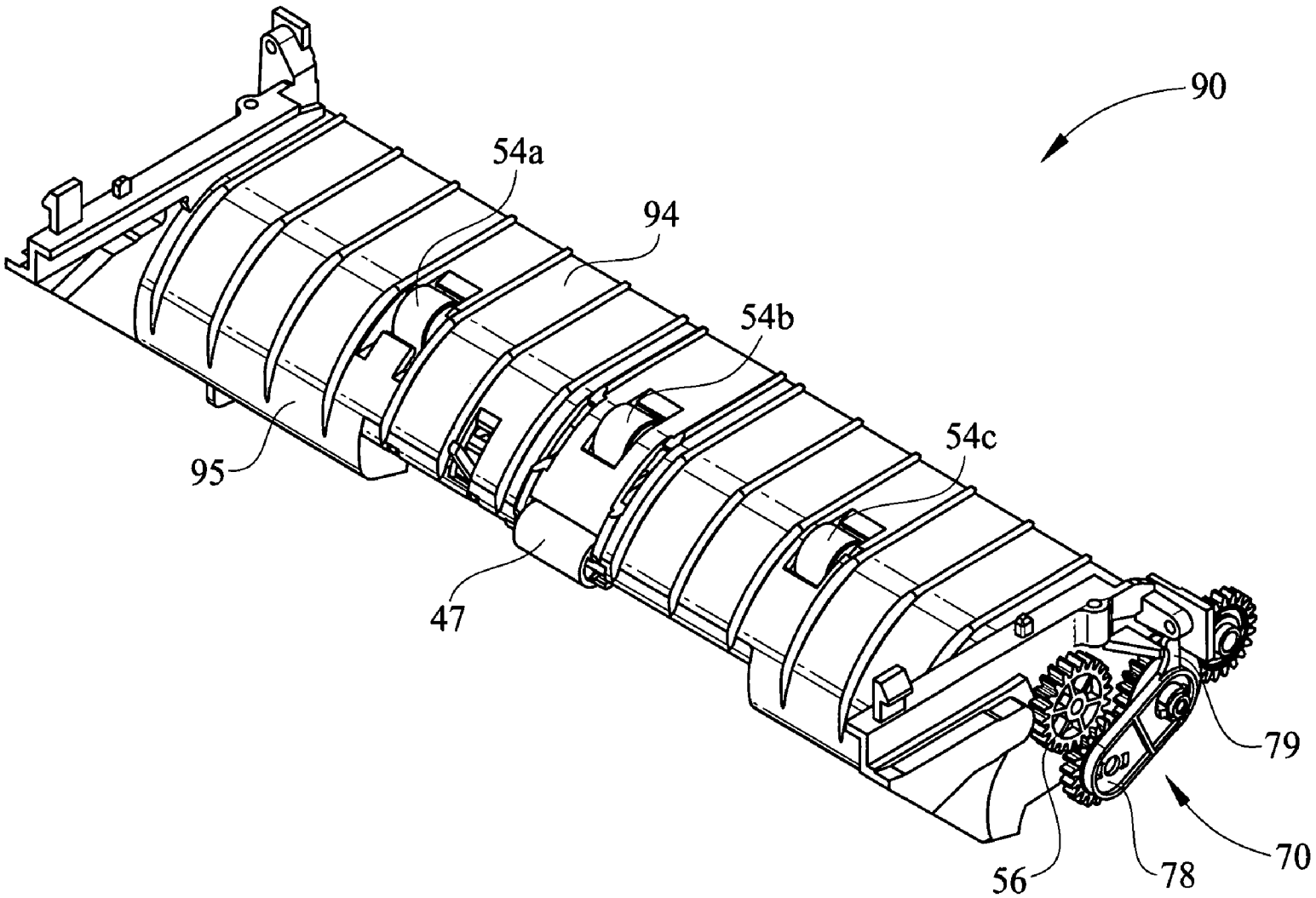
FIG. 4 depicts an alternative perspective view of the paper guide sub-assembly of FIG. 3.

Referring now to FIG. 4, a perspective view of the inner paper guide the sub-assembly 90 is depicted with the upper guide 96 (FIG. 3) removed. The media service 94 is shown having a curved area 95 partially defining one side of the C-shaped portion 36 of the feedpath 30. At a junction between the curved surface 95 and the flat surface 94 is the at least one nipless feed assist roller 54. Specifically, three rollers 54*a*, 54*b*, 54*c* are located in this area in the exemplary embodiment and disposed upon the feed assist shaft 52 for driving by the feed assist gear 56. The rollers 54*a*, 54*b*, 54*c* may be formed of metal or plastic and connected on the shaft 52 by various means. The rollers (collectively) 54 may be formed of a rubber material or may be plastic with a rubber material disposed along the outer periphery thereof in order to have some limited frictional engagement with the media passing through the feedpath 30.

The toggle arm 78 also comprises a stop 79 which is integrally molded with the arm 78. The stop 79 engages a portion of the paper guide assembly 92 and limits the toggle arm 78 movement in both a clockwise direction toward the feed assist gear 56 and a counter-clockwise direction away from the feed assist gear 56.

Figure 5:
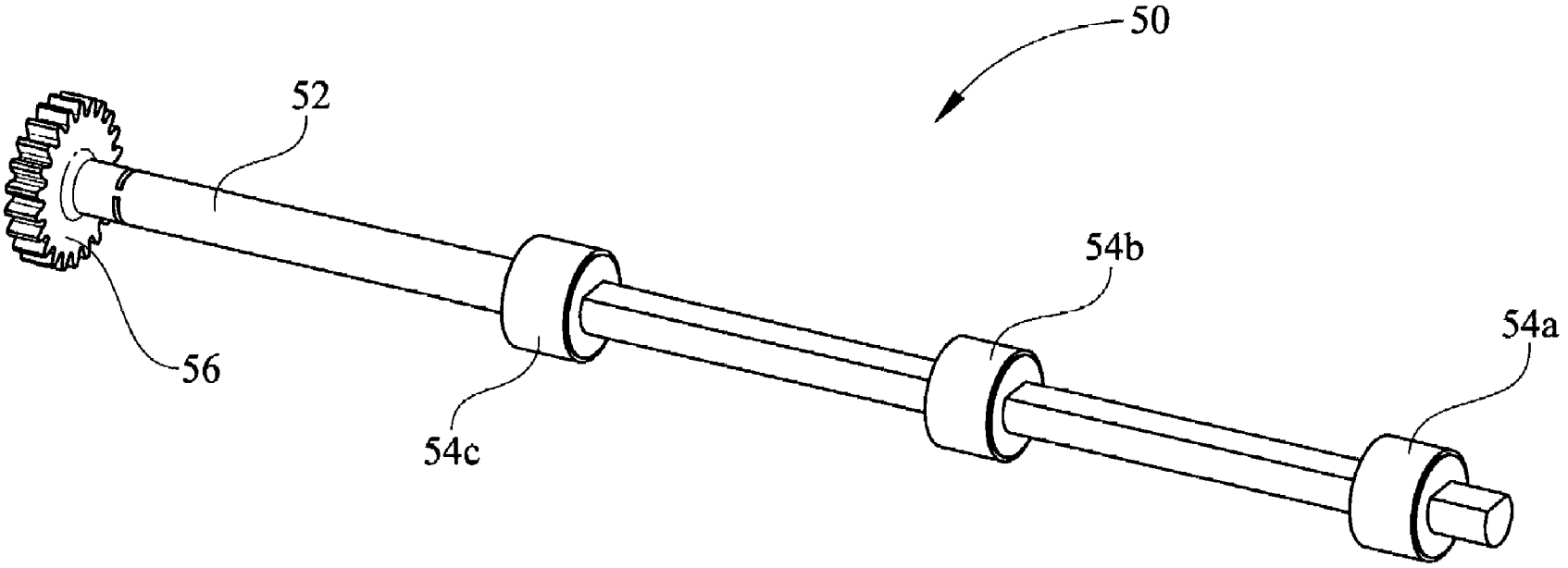
FIG. 5 depicts a perspective view of a feed assist roller assembly.

Referring now to FIG. 5, a perspective view of the nipless feed assist roller assembly 50 is depicted. The assembly 50 comprises a feed assist shaft 52 which is connected to and receives input from the feed assist gear 56. Rotation of the gear 56 causes rotation of the shaft 52 and the at least one roller 54 exposed on the shaft 52. In the exemplary embodiment three rollers 54*a*, 54*b*, 54*c* are depicted as being positioned on the shaft 52. Alternatively, a single roller may be utilized which is connected to the shaft 52 or two or more rollers may be used on one or more shafts.

Figure 6:
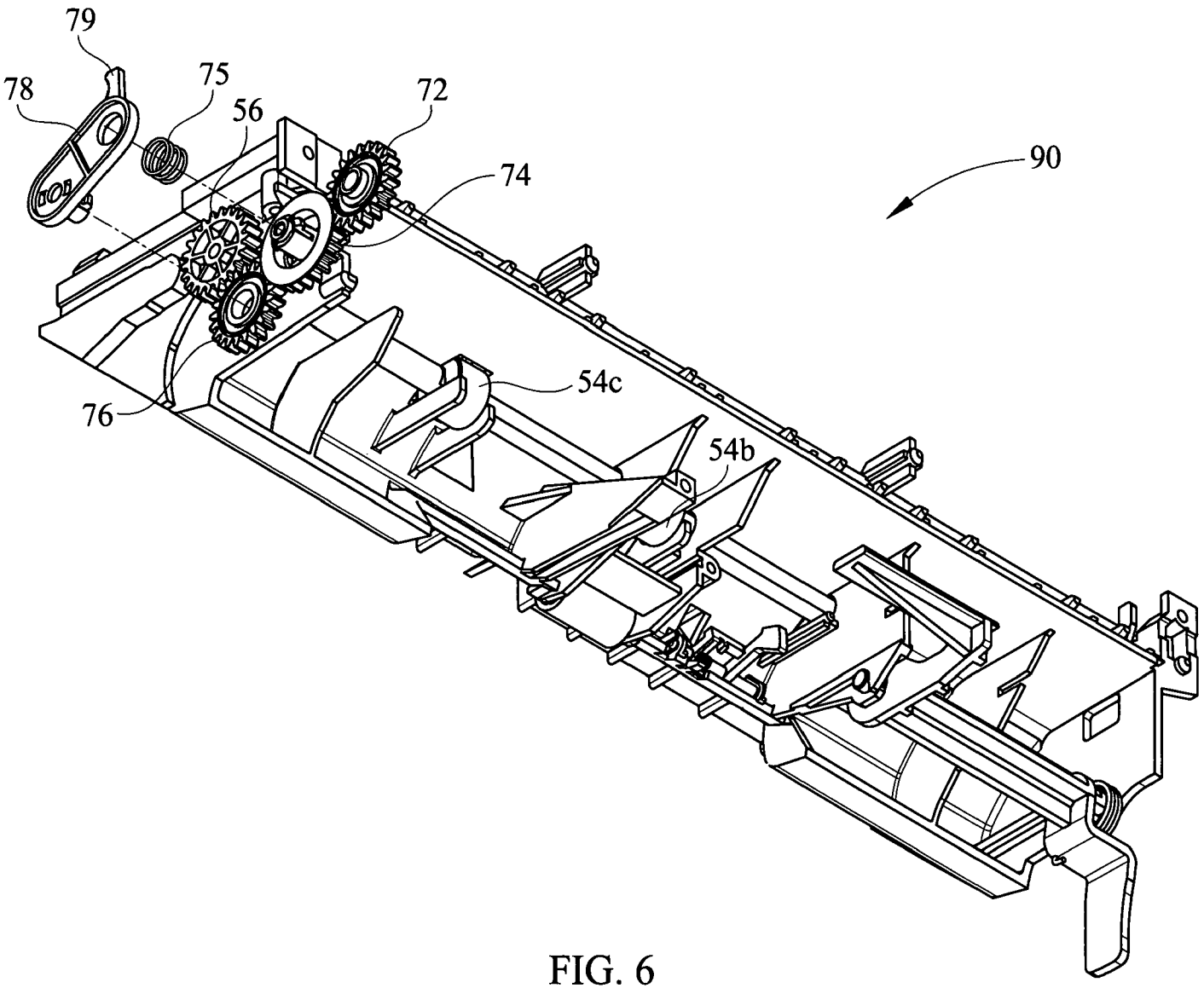
FIG. 6 depicts a lower perspective view of the paper guide sub-assembly with a toggle transmission assembly partially exploded; and, FIGS. 7-10 depict sequence views of media feeding through the feedpath having the feed assist roller assembly.
Figure 7:
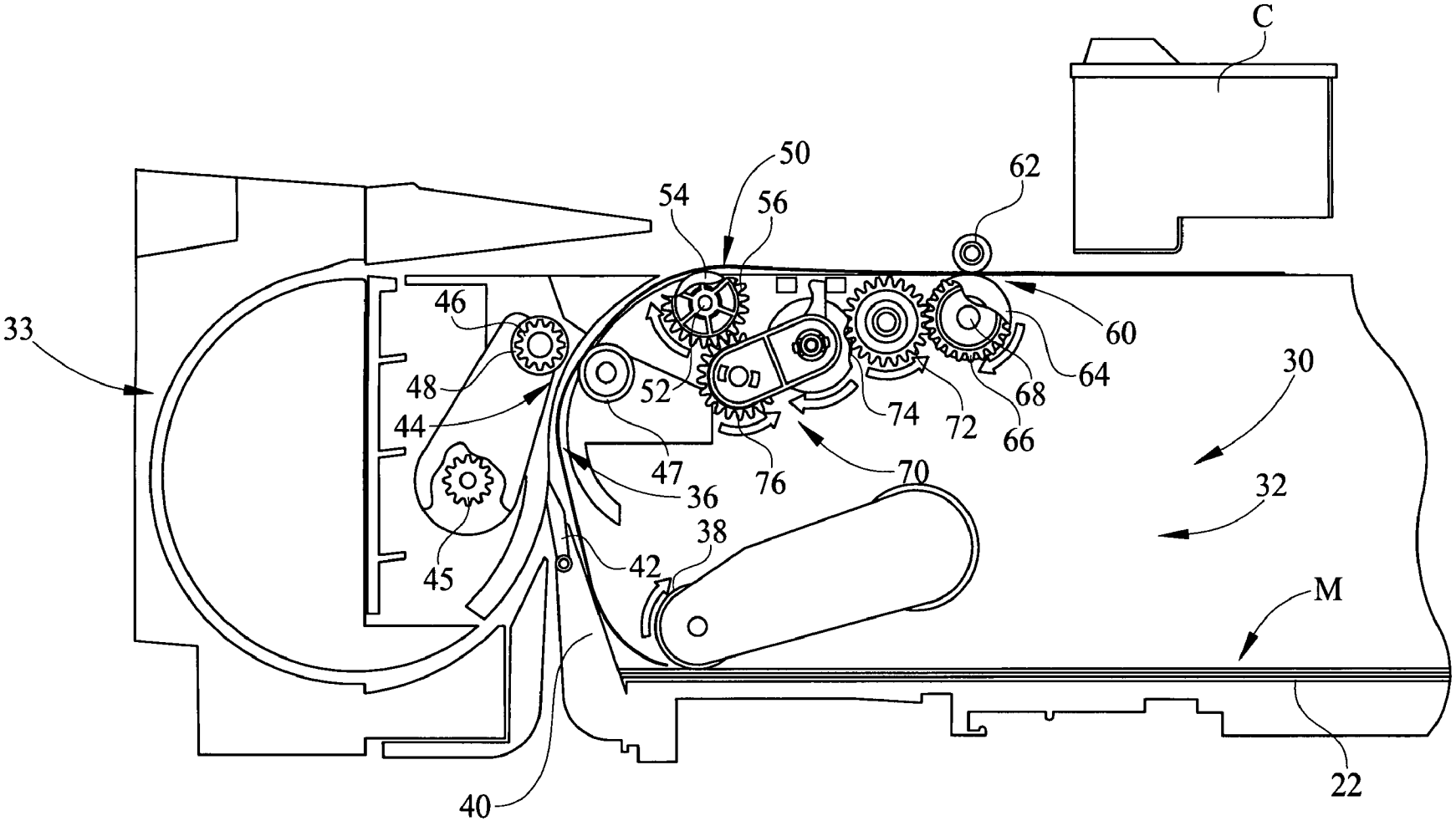

Referring now to FIG. 6, a lower perspective view of the paper guide sub-assembly 90 is depicted with the toggle transmission assembly 70 partially exploded. The first toggle transmission gear 72 and second toggle transmission gear 74 are aligned and operably engaging one another for driving motion from a feed roller gear 66 (FIG. 2). Opposite the second toggle transmission gear 74 is the toggle gear 76 which is moveably engagable with the feed assist gear 56. The toggle arm 78 is exploded from the sub-assembly 90 to depict a spring 75 which is exposed between the second toggle transmission gear 74 and the arm 78 to induce pivoting motion of the arm 78 with the rotation of gear 74. When the second gear 74 rotates in a clockwise direction, the toggle gear 76 moves in a clockwise direction until the feed assist gear 56 is engaged and a stop 79 engages a portion of the sub-assembly 90. When the motion of the arm 78 is limited, the toggle gear 76 rotates driving the feed assist gear 56 and be at least one roller 54. Alternatively, when the second gear 74 rotates in a counterclockwise direction, the toggle gear 76 moves away from the feed assist gear 56 so that the feed assist gear 56 is not driven and the at least one roller 54 also is not driven.

Referring now to FIGS. 7-10, operation of the nipless feed assist assembly 50 and media feedpath 30 is described. Initially, a stack of media M is positioned in the tray 22 for feeding by the input roller 38. A sheet of media is directed upwardly through the C-path portion past the nipless feed assist roller 54 and into the feed nip 60. When the media M is indexed by the media input roller 38, the media moves along the outer surface of the C-path portion 36 and in general does not engage the at least one roller 54. Once engaged by the feed nip 60 the media M is pulled downward against roller 54 for feed assist to nip 60. Feed nip 60 directs media to the print cartridge and indexes the media for passage by the cartridge C in order to affect printing an image on the media sheet. As the feed roller 64 rotates in a clockwise direction and feeds media toward the print cartridge C, the gear train 70 also rotates to drive the roller 54 in a clockwise direction. Since no pinch roller is used opposite the nipless feed assist roller 54, the nipless feed assist roller 54 only assists feeding of the media sheet due to frictional contact between the sheet and the roller surface or tire. Further, as previously described, the at least one roller 54 is slightly over-driven relative to the feed roller 64 so that a slight buckle may occur in the media sheet between the nipless feed assist roller 54 and the feed roller 64. With the slight buckle between the nipless feed assist roller 54 and the feed roller 64, resistive forces upstream of the feed roller nip 60 are reduced so that indexing by the feed roller nip 60 to the print zone beneath the cartridge C is accurate. The slight buckle in the media acts like a load buffer between the nipless feed assist roller 54 and the feed roller nip 60 which aids with the accuracy of indexing through the print zone by the feed roller nip 60.

Figure 8:
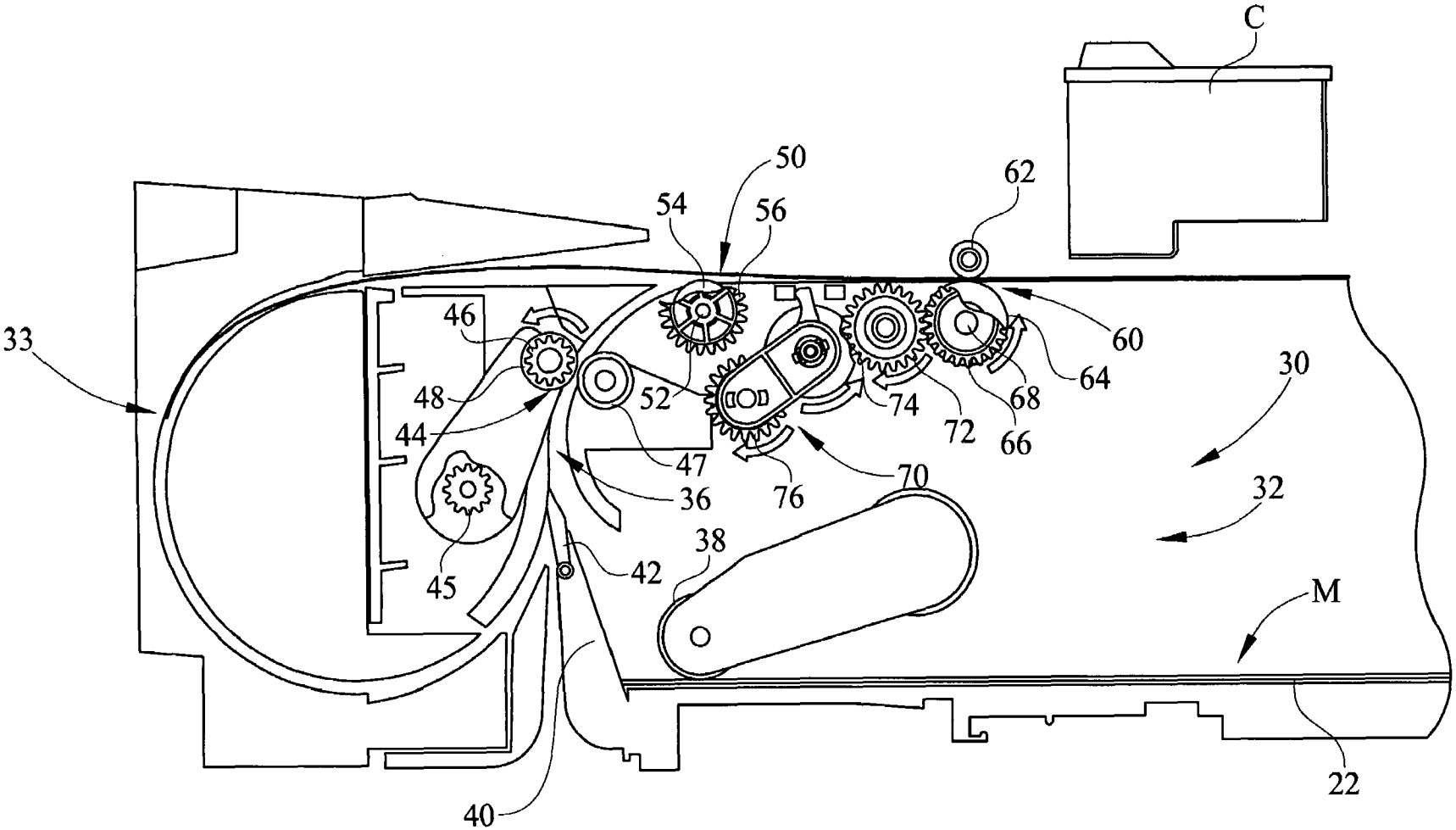

Referring now to FIG. 8, the feed roller 64 is shown reversed and rotating in a counterclockwise direction.

Accordingly the gear directions are depicted along the toggle transmission assembly 70 so that the toggle gear 76 is rotated with the arm 78 in the direction of rotation of the second toggle transmission gear 74 and the toggle gear 76 moves away from the feed assist gear 56. With the feed roller 64 rotating in a counterclockwise direction, the media sheet is reversed from the beneath the print cartridge C and moves backward through the feedpath 30 and into the duplex portion 33. The leading edge of the media is depicted within the duplex feedpath area 33 while the trailing edge is moving from the print area through the feed roller nip 60. Due to the resistance on the media in bending through the duplex path 33, the media sheet is bowed slightly and therefore may not be engaged by the nipless feed assist roller 54 which is not rotating due to the disengagement of the feed assist gear 56 by the toggle gear 76. Additionally, the feed nip 44 defined between the driven roller 48 and the pinch roller 47 is closed when the feed roller 64 is reversed and the rotation of the roller 48 is generally counterclockwise.

Figure 9:
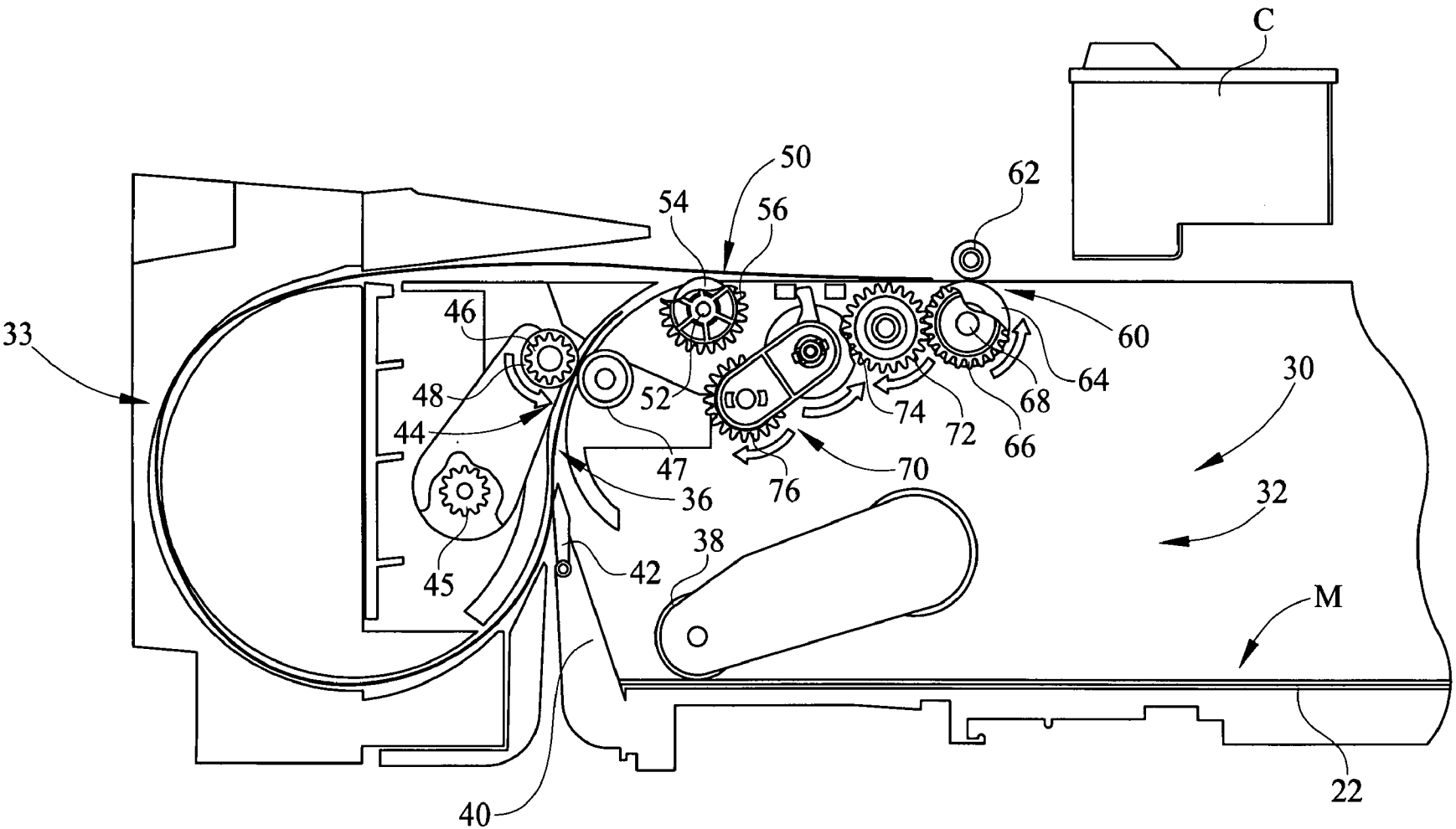

As shown in FIG. 9, the media M is still reversed and the leading edge is passed through the nip 44 defined between the roller 48 and pinch roller 47 with the driven roller 48 still rotating in a counterclockwise direction. The media leading edge is moving toward the nipless feed assist roller 54. Likewise, the leading edge is clear of the feed roller nip 60 and moving toward the duplexing portion 33 of the feedpath 30. In this figure, the media sheet is moving toward the print zone beneath the cartridge C in order to receive ink droplets on the second side of the media.

Figure 10:
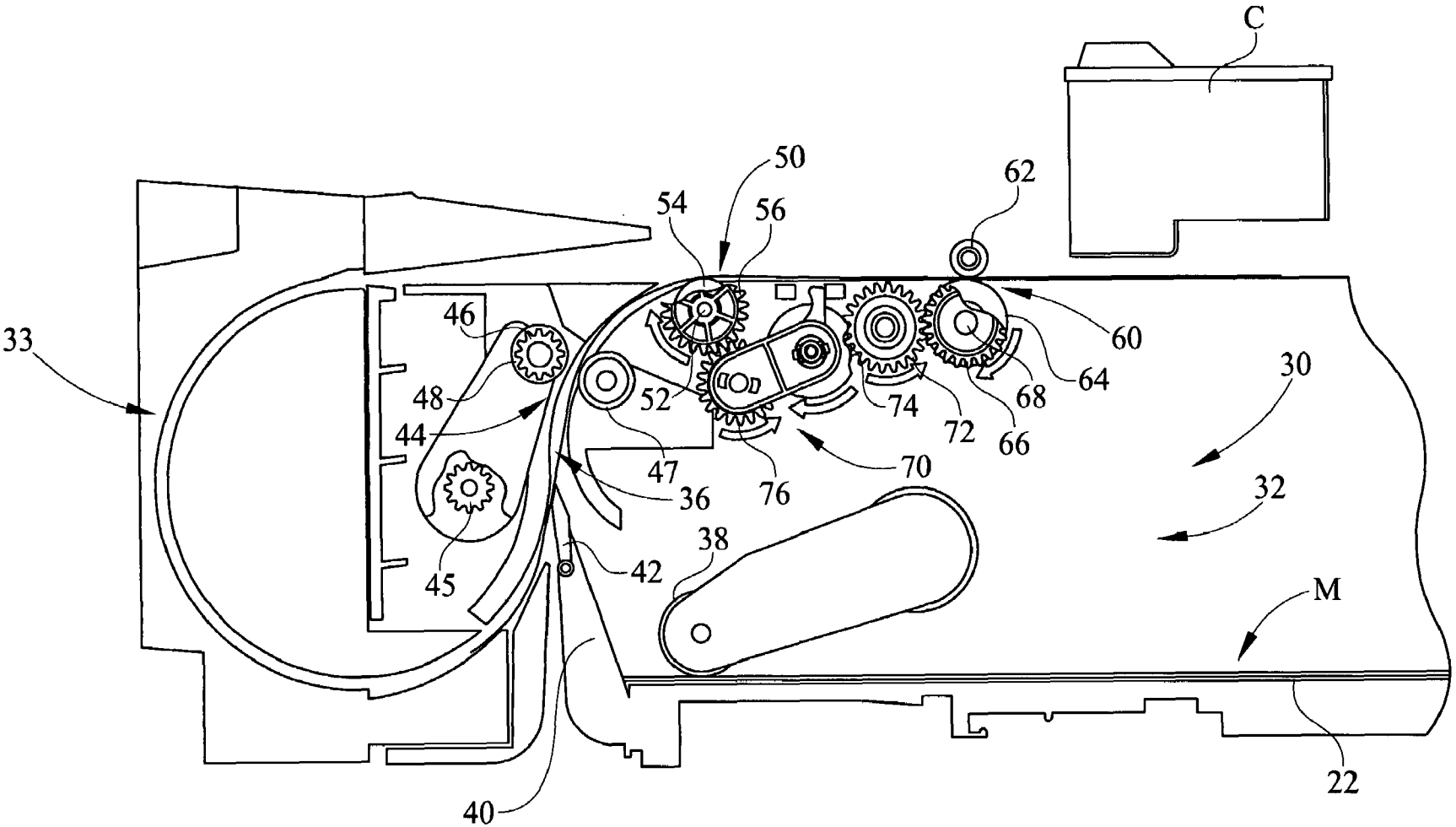

Referring now to FIG. 10, the media leading edge has engaged the feed roller nip 60 and the feed roller 64 has again reversed direction to rotate in a clockwise direction. Again, the media is pulled by nip 60 causing the media to engage the roller 54. Accordingly, the toggle transmission assembly 70 is engaging the feed assist gear 56 and causing rotation of the nipless feed assist roller 54. The frictional engagement of the roller 54 and the media sheet causes a slight buckle between the nipless feed assist roller 54 and the feed roller nip 60 which creates a load buffer and reduces resistance forces on the feed nip 60. This allows for improved accuracy in indexing of the media through the print zone beneath the cartridge C. As a result, fewer print defects occur. If desired the printed media may make an additional pass through the feedpath 30, specifically the duplex portion 33, in order to collate the media at the output 24 (FIG. 1).

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A media feedpath having a nipless feed assist assembly, comprising:

a media feedpath having a C-shaped portion, a media input and a feed roller nip;

an input roller feeding media from said media input;

a nipless feed assist roller downstream of said C-shaped portion of said media feedpath, said feed assist roller assisting media indexing through said media feedpath on a single side and without an opposed pinch roller;

said feed roller nip having a driven roller and a feed roller pinch roller opposite said driven roller;

said nipless feed assist roller being driven by a toggle gear transmission from said driven roller of said feed roller nip; and said toggle gear transmission adapted for toggling to operably engage or disengage said nipless feed assist roller depending on a driving direction of said driven roller of said feed roller nip.

2. The media feedpath of claim 1, said nipless feed assist roller spaced from a wall of said media feedpath allowing passage of media there between when said media is driven by said input roller.

3. The media feedpath of claim 1, said feed roller nip pulling said media against said nipless feed assist roller.

4. The media feedpath of claim 1, said toggle gear transmission engaging said nipless feed assist roller when said driven roller rotates in a forward direction.

5. The media feedpath of claim 4, said toggle gear transmission disengaging said nipless feed assist roller when said driven roller rotates in a reverse direction.

6. The media feedpath of claim 1, said toggle gear transmission being a gear train.

7. The media feedpath of claim 1 further comprising a gear generally connected to said nipless feed assist roller for engaging said gear train.

8. The media feedpath of claim 1 wherein said media feedpath is a simplex feedpath.

9. The media feedpath of claim 1 wherein said media feedpath is a duplex feedpath.

10. A feed assist media feedpath assembly, comprising:

a media feedpath having a media input, a C-shaped portion downstream of said media input, and a feed nip downstream of said C-shaped portion;

a nipless feed assist roller positioned between said C-shaped portion and said feed nip for feeding media;

said nipless feed assist roller being over-driven relative to a driven roller of said feed roller nip; and a toggle gear train assembly driving said feed assist roller in a forward direction or disengaging said nipless feed assist roller when said driven roller is reversed.

11. The feed assist media feedpath of claim 10, said nipless feed assist roller creating a load buffer in said media between said nipless feed assist roller and said feed roller nip.

12. The feed assist media feedpath of claim 11, said load buffer being a slight buckle in said media for reducing resistive forces on said nipless feed roller nip.

13. The feed assist media feedpath of claim 10, said media feedpath comprising a simplex feedpath portion.

14. The feed assist media feedpath of claim 13, said media feedpath further comprising a duplex feedpath portion.

15. The feed assist media feedpath of claim 10, said nipless feed assist roller disposed at a junction between said simplex path and said duplex path.

16. A nipless feed assist assembly for a media feedpath, comprising:

a media feedpath having a simplex portion and a feed roller;

a nipless feed assist roller disposed along said feedpath;

a toggle gear train assembly driven by a feed roller gear, said toggle gear train assembly movable between a first position engaging a feed assist gear for driving said feed assist roller and a second position disengaging said feed assist gear; and said nipless feed assist roller frictionally engaging media in order to assist movement of media through said media feedpath and overdriven relative to said feed roller to provide a load buffer at said nipless feed assist roller.

* * * * *